US005927347A

United States Patent [19]

Palau et al.

[11] Patent Number: 5,927,347

[45] Date of Patent: Jul. 27, 1999

[54] MODULAR SHED-FORMING DEVICE FOR A JAQUARD LOOM

[75] Inventors: Joseph Palau, Annecy; Dario Bassi, Chaponnay, both of France

[73] Assignee: Staubli Lyon, Chassieu, France

[21] Appl. No.: 08/989,654

[22] Filed: Dec. 12, 1997

[30] Foreign Application Priority Data

Dec. 19, 1996 [FR] France ..... 96-16004

[51] Int. Cl.[6] ..... D03C 3/36; D03C 3/06

[52] U.S. Cl. ..... 139/65

[58] Field of Search ..... 139/65, 62, 59

[56] References Cited

U.S. PATENT DOCUMENTS

| | | | |
|---|---|---|---|
| 4,936,352 | 6/1990 | Keim . | |
| 5,031,668 | 7/1991 | Bell | 139/59 |
| 5,115,838 | 5/1992 | Derudder | 139/65 |
| 5,176,181 | 1/1993 | Bassi | 139/62 |
| 5,183,080 | 2/1993 | Bassi et al. . | |
| 5,513,676 | 5/1996 | Speich | 139/65 |

FOREIGN PATENT DOCUMENTS

| | | |
|---|---|---|
| 0297586 | 1/1989 | European Pat. Off. . |
| 0488915 | 6/1992 | European Pat. Off. . |
| 2669650 | 5/1992 | France . |

*Primary Examiner*—Andy Falik
*Attorney, Agent, or Firm*—Dowell & Dowell, P.C.

[57] ABSTRACT

A shed-forming device for a weaving loom of the jacquard type in which a reciprocating vertical movement of two series of knives is effected from an input drive shaft which is drivingly connected through a cam mechanism to two longitudinal shafts disposed concentrically with respect to one another inside a rigid tube mounted between plates for supporting the shafts and wherein the cam mechanism transmits a reciprocating rotary movement from the input drive shaft to the two longitudinal shafts.

10 Claims, 3 Drawing Sheets

MODULAR SHED-FORMING DEVICE FOR A JAQUARD LOOM

BACKGROUND OF THE INVENTION

1. Field of the Invention

The present invention relates to a device for forming the shed in a Jacquard-type weaving loom, to a process for mounting such a device and to a weaving loom equipped with such a shed-forming device or mounted in accordance with such a process. The invention is more particularly centered on the vertical actuation, in phase opposition, of the two series of blades or knives which ensure control of the hooks of a weave system.

2. Description of the Related Art

In a shed-formation device, hooks are disposed in parallel rows separated from one another by spaces, in each of which a knife moves vertically. This knife is most often supported by one of two griffe frames. Each frame is suspended from levers animated by an oscillating movement so as to lower and rise alternately, it being observed that the vertical displacements of the knives are effected simultaneously, in opposite directions, in order to open the shed for insertion of the weft yarn.

In conventional systems, such as disclosed in particular in French Patent Application FR-A-2 669 650, a single shaft is provided, which is connected to the main shaft of the weaving loom and which extends over the whole width of the frame of the system. In the vicinity of each of its ends, this shaft, which is animated by a movement of continuous rotation, is equipped with two adjacent systems of cams or eccentrics adapted to transform this continuous rotation into a reciprocating rotation in order to give the lever which bears the griffe frames the desired lowering and rising movement. These conventional systems present a certain number of drawbacks. The presence of the mechanisms for transforming the continuous movement into reciprocating movement substantially increases the cost of the assembly, at the same time as increasing the dimensions of the actuation mechanism and hindering accessibility to the hooks of the system. Furthermore, these transformation mechanisms complicate the general structure of the frame.

In addition, the driven shaft of the weaving loom on which the shed-forming device must be installed, may be located to the left or to the right of the loom. It is usual to provide that the shed-forming device be fitted on looms with driven shaft to the left or to the right. However, it may happen that the weaver using the loom decides to change the type or supplier of loom while maintaining his choice concerning the shed-forming device, with the result that it is sometimes necessary to change the entry side of the movement in the shed-forming device. With the known devices, this modification is long and complex. In particular, it induces considerable interventions on the peripheral members of the system such as the chassis and the transmission elements.

SUMMARY OF THE INVENTION

It is a principal object of the present invention to overcome these drawbacks by essentially providing two longitudinal shafts disposed coaxially inside a rigid tube secured to two plates supporting the shafts and with a cam mechanism transmitting a reciprocating movement of rotation from an input shaft of the shed-forming device to easily the longitudinal shafts.

Thanks to the invention, the coaxial longitudinal shafts constitute an efficient and non-complex device making it possible to transform, with the cam mechanism, the movement of the input shaft into movement controlling the griffe frames. Thanks to the rigid tube, the plates and the coaxial longitudinal shafts constitute a solid assembly which may be manipulated in unitary manner, for example by means of a block and pulley, in order to be placed on the structure of the shed-forming device. In this way, a considerable flexibility during manufacture of shed-forming devices according to the invention is obtained, insofar as the assembly formed by the longitudinal shafts, the tube, the plates and the cam mechanism may be mounted on the structure of the device when the side by which the movement enters in the shed-forming device is known for sure.

According to a first advantageous aspect of the invention, the plates are removably mounted on the structure of the device. This aspect of the invention facilitates maintenance operations, as, when it is necessary to access, for example, the modules for selecting the hooks of the shed-forming device, the plates may be disconnected from the structure and the drive assembly formed by the plates, shafts, tube and cam mechanism may be removed.

According to another advantageous aspect of the invention, the plates may be mounted on the structure in two positions, corresponding respectively to the positioning of the input shaft on one side or the other of the device. This aspect of the invention therefore enables a shed-forming device with input of the movement to the right or to the left, to be produced with the same drive assembly.

In accordance with a first advantageous embodiment of the invention, the plates are asymmetrical, i.e. the axis common to the longitudinal shafts and to the tube is offset with respect to the median axis of the plates. This variant of the invention makes it possible to obtain an oblique shed.

In accordance with another advantageous variant of the invention, the plates are symmetrical, i.e. the axis common to the longitudinal shafts and to the tube is secant with respect to the median axis of the plate. This aspect of the invention makes it possible to use the same plates for mounting in the two positions corresponding to an input of the movement to the right and an input of the movement to the left.

According to another particularly advantageous aspect of the invention, which may be used with all types of plates, when the shed-forming device comprises electromagnetic modules for selecting the hooks in abutment on the knives, these modules are distributed in baskets adapted to be placed in position in the device once the modules are in place in the baskets. This aspect of the invention makes it possible to prepare the modules outside the shed-forming device, i.e. in particular on a work bench allowing an operator to do good-quality work comfortably, then to install them in groups in the device of the invention.

The invention also relates to a process for mounting a shed-forming device, in particular as described hereinbefore. This process is characterized in that it consists in pre-mounting on the one hand a structure equipped with selection modules and, on the other hand, a rigid drive assembly comprising two longitudinal shafts disposed coaxially inside a rigid tube secured to two plates and a cam mechanism, and in mounting the drive assembly on the structure equipped with modules. This two-step assembly makes it possible both to render manufacture of the device easier, in particular concerning the entry side of the drive movement, and to improve work conditions for the operators who can carry out their tasks under conditions adapted to the mounting of each sub-assembly in question. In particular, the drive assembly may, if necessary, be pre-mounted in a clean room and moved towards the structure of the shed-forming device when all its protection hoods are in place.

In accordance with an advantageous variant of the invention, the process further consists in equipping the structure with modules distributed in pre-mounted baskets. This further facilitates the operators' work.

According to another advantageous aspect of the process of the invention, the drive assembly is removably mounted on the module-equipped structure. The fact of being removable makes it possible to disconnect these assemblies, in particular in the case of change in the customer's order or for maintenance operations.

Finally, the invention relates to a weaving loom of the Jacquard type equipped with a shed-forming device as described hereinbefore or using the process set forth hereinbefore.

BRIEF DESCRIPTION OF THE DRAWINGS

The invention will be more readily understood on reading the following description of an embodiment of a shed-forming device for weaving loom, given by way of example and with reference to the accompanying drawings, in which.

DESCRIPTION OF PREFERRED EMBODIMENT

Figure 1:
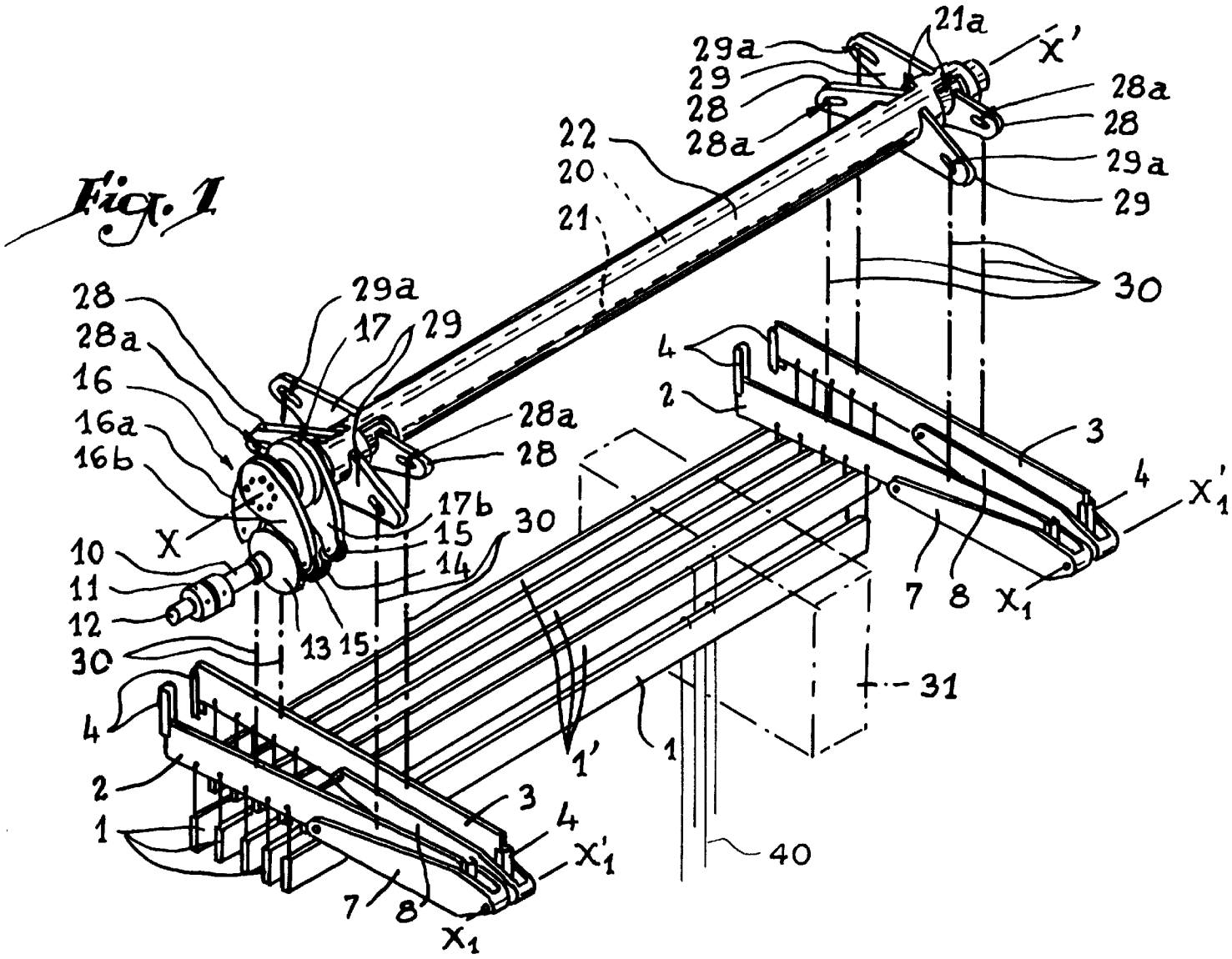
FIG. 1 is a view in perspective of the kinematic elements of a shed-forming device according to the invention.

Referring now to the drawings, FIG. 1 shows the knives or blades of a shed-forming mechanism divided into two groups 1 and 1', each suspended from a griffe frame animated by vertical reciprocating movements in phase opposition. The griffe frames are formed by bars 2 and 3. The ends of the bars 2 and 3 are engaged in slideways 4 rigidly fixed to the frame of the device which is not shown in FIG. 1, but which appears in FIG. 2 in the form of two C-section beams 5 and 6.

In order to improve guiding of its reciprocating vertical movement, each bar belonging to the griffe frame is associated with a substantially horizontal lever. These levers bear references 7 and 8 and are respectively associated with the bars 2 and 3. One of the ends of each lever is coupled to the corresponding bar, while the opposite end pivots on the fixed frame about a fixed axis $X_1$–$X_1'$. If the depth of the machine, sometimes called loading depth, is relatively small, for example less than 800 mm, the slideways 4 may be eliminated, as the bars 2 and 3 have a length not requiring very precise guiding.

Above the knives 1 and 1', there is mounted a shaft 10 for entry of the movement of the shed-forming device. This shaft 10 is connected by means of a coupling 11 to a second shaft 12 driven in continuous rotation by the shaft of the weaving loom with which the shed-forming device is associated.

Figure 3:
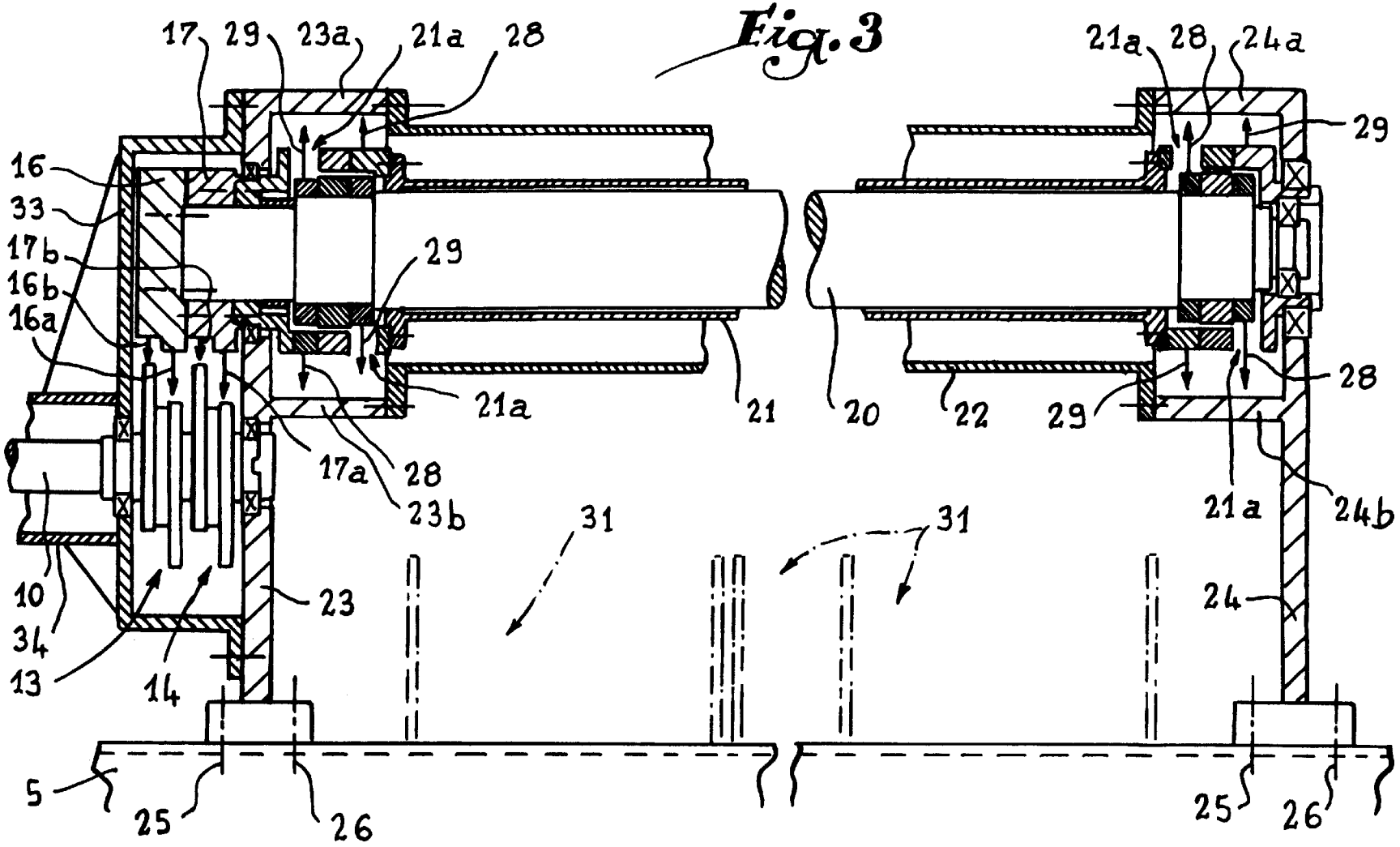
FIG. 3 is a schematic partial axial section of a device according to the invention.

On that part of the shaft 10 which is disposed opposite the coupling 11, there are fitted two conjugate cams 13 and 14 which appear more clearly in FIG. 3. Each cam 13 or 14 is constituted, in manner known per se, by two eccentric discs, fixed side by side on the same hub, the offsets being oriented opposite each other in each cam. The periphery of the discs of the two cams 13 and 14 form a track for rollers 15, represented in the form of arrow heads, which are carried by radial arms 16*a*, 16*b*, 17*a* and 17*b*, oriented opposite one another and offset axially with respect to one another. These arms form two balances 16 and 17. Balance 16 is fixed at the end of a shaft 20, mounted coaxially inside a shaft 21 of length slightly shorter than that of the shaft 20. Balance 17 is fixed at the end of shaft 21.

Figure 2:
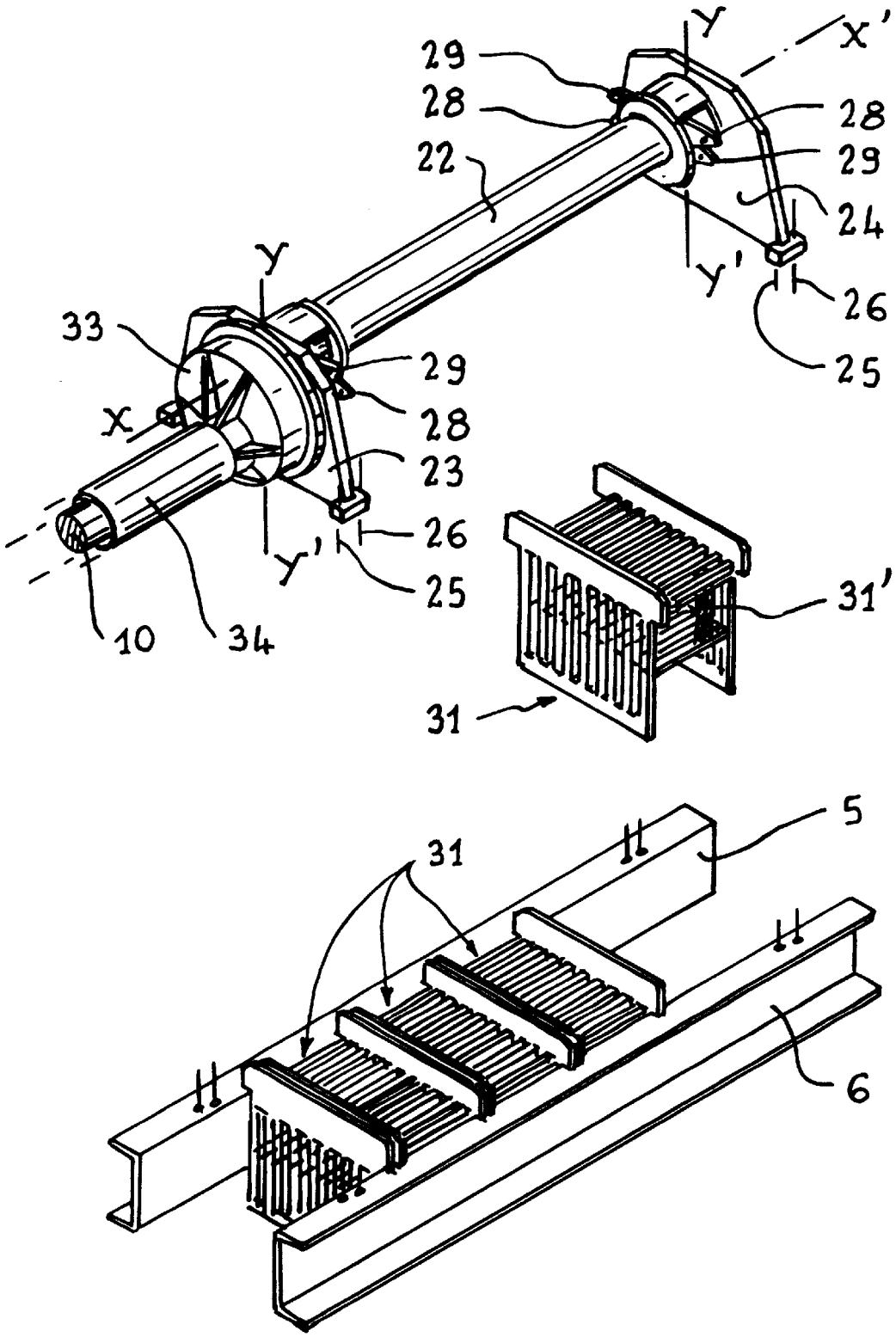
FIG. 2 is an exploded view in perspective of a shed-forming device according to the invention in the course of being mounted.

According to the invention, the two shafts 20 and 21 are disposed coaxially inside a rigid tube 22 secured to two plates 23 and 24 capable of being assembled on the beams 5 and 6, for example by means of screws represented by their axes 25 and 26 in FIG. 2. The two coaxial shafts 20 and 21 are suitably supported for rotation in rollers bearings added in the plates 23 and 24 and they are oriented along the median longitudinal axis of the frame of the system in the upper part thereof. The cam mechanism constituted by elements 13 to 17 ensures the transformation of the movement of continuous rotation of the input shaft 10 into an oscillating movement, while the two coaxial shafts 20 and 21 are animated by a reciprocating displacement, in synchronism and in phase opposition, with respect to each other.

In the immediate vicinity of the inner face of each of the two plates 23 and 24, the outer shaft 21 has two slots 21 a cut out therein, offset axially with respect to each other and oriented opposite each other. Each of these slots 21 a is traversed by a lever 28 radially fixed to the inner shaft 20. Opposite each lever 28, a lever 29 is radially secured to the outer shaft 21 along the axis of the corresponding lever 28. Each of the pairs of opposite levers 28 and 29 therefore constitutes a sort of balance beam which the two concentric shafts 20 and 21 animate by an oscillating movement.

As shown in FIG. 2, the tube 22 makes it possible to constitute a rigid assembly which may be qualified as "drive assembly" with shafts 10, 20 and 21 and plates 23 and 24, this assembly being able to be mounted, in one operation, on a structure which comprises modules for selecting the hooks 40 belonging to the shed-forming device.

The tube 22 is connected to the plates 23 and 24 thanks to upper (23*a* and 24*a*) and lower (23*b* and 24*b*) extensions disposed respectively above and below the pairs of levers 28 and 29 at the two ends of the tube 22.

Each lever 28 and 29 is provided with an arcuate slot 28*a*, 29*a*, respectively, for the adjustable attachment of a vertical rod 30 represented as axis lines in FIG. 1. Rods 30 make it possible to lift bars 2 and 3 alternately. In this way, the movement of the knives 1 and 1' is obtained from the rotation of the shaft 10 thanks to the transformation of the continuous movement of rotation into a reciprocating oscillation movement inside the tube 22.

According to a particularly advantageous aspect of the invention, baskets 31 are provided, in which selection modules 31', for example electromagnets, are installed, intended to immobilize the hooks connected to the heddles of the harness of the Jacquard system at a given point of their path. These modules may be of any known type. By using the baskets 31, which are shown empty in FIG. 2 except for one module 31' in order to simplify the drawing, they can be filled with modules in a chosen configuration, then these modules 31' can be positioned in groups, each corresponding to a basket 31, between the beams 5 and 6. This modus operandi facilitates assembly in that each basket may be equipped with a chosen number of modules which may be tested by means of a device of suitable capacity.

The baskets 31 are then easily positioned between the beams 5 and 6 as access to the space between these beams is free due to the fact that the drive device of the bars 2 and 3, visible in FIG. 1, is not yet installed. Another operator may proceed, in a workshop for that purpose, and in particular in a clean room, with the mounting of the rigid drive assembly which comprises the input shaft 10, the two longitudinal shafts 20 and 21, the tube 22, the plates 23 and 24 and the cam mechanism 13 to 17 which appears once mounted in the upper part of FIG. 2. It is noted that this drive assembly is provided with a hood 33 which protects the cam mechanism while a sleeve 34 surrounds the shaft 10, while being fixed on the hood 33. In this way, the drive assembly is a rigid, robust device which may be manipulated, for example by means of a block and pulley, in order to be positioned on the structure, represented by the beams 5 and 6, equipped with the modules, after the baskets 31 have been placed in position.

According to an advantageous aspect of the invention, the drive assembly is removably mounted on the beams 5 and 6, so that, for a maintenance operation, it is possible to separate the drive assembly from the rest of the structure of the shed-forming device in order to intervene on the modules by withdrawing the baskets 31.

Having regard to FIG. 2 in particular, it will be understood that the drive assembly formed by the shafts 20 and 21, the tube 22, the plates 24 and 25 and the input shaft 10, the hood 33 and the sleeve 34 may be mounted on the beams 5 and 6 in two positions, corresponding respectively to the positioning of the input shaft 10 on one side of the device or the other. This therefore makes it possible to adapt a shed-forming device according to the invention to the customer's wishes, including when he must be satisfied quickly. In fact, it suffices to keep, in the manufacturer's stock of shed-forming devices, an adequate number of drive assemblies and an adequate number of shed-forming device structures.

The median axis YY' of the plates 23 and 24 is noted. As shown in FIG. 2, this axis is offset with respect to the axis XX' common to the shafts 20 and 21 and to the tube 22. This corresponds to a more rational construction of the drive assembly in which the inclination of the rods 30 is limited, while the forces on the levers 7 and 8 are maintained at a low level. In particular, the obliqueness of the shed may be adjusted by means of the arcuate slots 28*a* and 29*a*. The non-symmetrical construction of the plates 23 and 24 also makes it possible to limit the dimensions of the arcuate slots 28*a* and 29*a*.

However, in accordance with a variant of the invention (not shown), the plates 23 and 24 may be provided to be symmetrical, i.e. axis XX' being secant with respect to the median axis YY' of these plates, with the result that the same drive assembly may equally well be mounted with the input shaft oriented on one side of the shed-forming device or the other. This device is also capable of making an oblique shed, even if the mechanical stresses are greater than in the case of the plates being asymmetrical.

According to an advantageous aspect of the invention, the rigid structure formed essentially by the tube 22 and the plates 23 and 24, makes it possible to support the shaft 10 in overhang, which avoids providing a force absorbing member on the beams 5 and 6 for supporting the shaft 10. The lower structure of the device of the invention is thus simplified.

What is claimed is:

1. A drive assembly adapted for vertically reciprocating knives of a pair of griffe frames of a shed-forming device of a weaving loom having a frame wherein the griffe frames are responsive to a continuous rotary motion of a primary drive shaft and wherein the drive assembly is adapted to be connected to rods used to raise and lower the griffe frames, the drive assembly comprising; a first driven shaft mounted within a second driven shaft, a pair of spaced support plates, means for supporting opposite ends of each of said first and second driven shafts so as to permit rotary motion of said first and second driven shafts about an elongated axis about which said first and second driven shafts are oriented, a cam assembly adapted to drivingly connect said first and second driven shafts to the primary drive shaft to thereby drive said first and second driven shafts in an oscillating rotary motion, an outer tube extending between and connected to said pair of spaced support plates, said first and second driven shafts being disposed within said outer tube, and means extending from each of said first and second driven shafts outwardly of said outer tube adapted to drivingly engage the rods and to raise and lower the griffe frames.

2. The drive assembly of claim 1 including means adapted to removably mount said pair of spaced plates to spaced support beams of the frame of the weaving loom.

3. The drive assembly of claim 1 wherein each of said spaced support plates includes a median vertical axis which is off-set relative to said elongated axis of said first and second driven shafts.

4. The drive assembly of claim 1 wherein said means extending from each of said first and second driven shafts includes a pair of generally oppositely oriented levers mounted adjacent said opposite ends of said first and second driven shafts, a first plurality of openings in said second driven shaft through which said levers mounted to said first driven shaft extend, and a second plurality of openings in said outer tube thorough which said levers of each of said first and second driven shafts extend.

5. The drive assembly of claim 1 in which said cam assembly includes a drive input shaft, and means for connecting said drive input shaft to the primary drive shaft.

6. A weaving loom comprising; a pair of griffe frames of a shed-forming device having vertically reciprocating knives, a drive assembly for vertically reciprocating said knives, a primary drive shaft, said drive assembly including a first driven shaft mounted within a second driven shaft, a pair of spaced support plates, means for supporting opposite ends of each of said first and second driven shafts so as to permit rotary motion of said first and second driven shafts about an elongated axis about which said first and second driven shafts are oriented, a cam assembly, means for connecting said cam assembly to the primary drive shaft and to said first and second driven shafts so as to drive said first and second driven shafts in an oscillating rotary motion, an outer tube extending between and connected to said pair of spaced support plates, said first and second driven shafts being disposed within said outer tube, and means extending from each of said first and second driven shafts outwardly of said outer tube adapted to drivingly engage rods to thereby raise and lower said griffe frames.

7. The weaving loom of claim 6 further including a frame including spaced support beams, and means for removably mounting said pair of spaced plates to said support beams.

8. The weaving loom of claim 6 wherein said means extending from each of said first and second driven shafts includes a pair of generally oppositely oriented levers mounted adjacent said opposite ends of said first and second driven shafts, a first plurality of openings in said second driven shaft through which said levers mounted to said first driven shaft extend, and a second plurality of openings in said outer tube through which said levers of each of said first and second driven shafts extend.

9. The weaving loom of claim 6 including a plurality of electromagnetic modules for selecting hooks engageable by said knives, a plurality of basket means, each of said basket means selectively retaining a number of said plurality of electromagnetic modules, and said plurality of said basket means being adapted to be supported by spaced beams of the frame of the weaving loom.

10. A process for mounting a shed-forming device including a selection module housing in a rigid drive assembly in a jacquard weaving loom comprising the steps of:

A) providing a structure for housing hook selection modules,

B) further providing a rigid drive assembly comprising two longitudinal shafts disposed coaxially inside a rigid tube wherein a cam mechanism is attached to the two longitudinal shafts and mounting plates are attached to the tube, C) placing the hook selections modules in said structure, and D) mounting said drive assembly on said structure.

* * * * *